US009443674B1

(12) United States Patent
Chen

(10) Patent No.: US 9,443,674 B1
(45) Date of Patent: Sep. 13, 2016

(54) ILLUMINATED KEYBOARD DEVICE

(71) Applicant: Primax Electronics Ltd., Neihu, Taipei (TW)

(72) Inventor: Bo-An Chen, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 14/723,062

(22) Filed: May 27, 2015

(30) Foreign Application Priority Data

Mar. 27, 2015 (TW) ..... 104109990 A

(51) Int. Cl.

| | |
|---|---|
| ***H01H 9/26*** | (2006.01) |
| ***H01H 13/7065*** | (2006.01) |
| ***H01H 13/703*** | (2006.01) |
| ***H01H 13/83*** | (2006.01) |
| ***H01H 13/704*** | (2006.01) |

(52) U.S. Cl.
CPC ..... *H01H 13/7065* (2013.01); *H01H 13/703* (2013.01); *H01H 13/704* (2013.01); *H01H 13/83* (2013.01); *H01H 2219/036* (2013.01); *H01H 2219/062* (2013.01); *H01H 2221/044* (2013.01); *H01H 2227/036* (2013.01)

(58) Field of Classification Search
CPC ..... H01H 13/7065; H01H 13/703; H01H 13/704; H01H 13/83; H01H 2219/036; H01H 2219/062; H01H 2221/044; H01H 2/036
USPC ..... 200/5 A, 310–314, 512, 517, 344–345; 362/555, 558, 559, 616, 26, 27
See application file for complete search history.

(56) References Cited

U.S. PATENT DOCUMENTS

| | | | | |
|---|---|---|---|---|
| 7,588,338 | B2 * | 9/2009 | Chou | G06F 3/0202 200/314 |
| 7,709,760 | B2 * | 5/2010 | Chen | G06F 3/0202 200/310 |
| 8,071,900 | B2 * | 12/2011 | Hsu | G06F 3/0202 200/314 |
| 8,810,438 | B2 * | 8/2014 | Tsai | H01H 9/18 200/315 |

* cited by examiner

*Primary Examiner* — Edwin A. Leon
(74) *Attorney, Agent, or Firm* — Kirton McConkie; Evan R. Witt

(57) ABSTRACT

An illuminated keyboard device includes plural keys, a membrane switch circuit module and plural light-emitting elements. The membrane switch circuit module is located under the plural keys. The plural light-emitting elements and plural light source wiring lines are disposed on the membrane switch circuit module. The plural light-emitting elements are connected with each other through the plural light source wiring lines. Since the plural light-emitting elements and the plural light source wiring lines are disposed on the membrane switch circuit module, it is not necessary to install a backlight module.

13 Claims, 9 Drawing Sheets

ILLUMINATED KEYBOARD DEVICE

FIELD OF THE INVENTION

The present invention relates to a keyboard device, and more particularly to a keyboard device with an illuminating function.

BACKGROUND OF THE INVENTION

A keyboard device is one of the widely-used computer peripheral devices. Via the keyboard device, the user may input characters or commands into a computer. With increasing development of science and technology, the keyboard device manufacturers make efforts in designing novel keyboard devices with diversified functions in order to meet the requirements of different users. Recently, an illuminated keyboard device with an illuminating function has been introduced into the market. Consequently, in case that the illuminated keyboard device is used in the dim environment with insufficient luminance, the characters marked on the keys of the illuminated keyboard device are still clearly visible to the user.

Hereinafter, the structure of a conventional illuminated keyboard device will be illustrated with reference to FIG. 1. FIG. 1 is a schematic cross-sectional view illustrating a conventional illuminated keyboard device.

Firstly, the components of the conventional illuminated keyboard device will be described. As shown in FIG. 1, the conventional illuminated keyboard device 1 comprises at least one key 11, a membrane switch circuit module 12, a supporting plate 13 and a backlight module 14.

The key 11 comprises a keycap 111, a scissors-type connecting element 112 and an elastic element 113. Moreover, the membrane switch circuit module 12 comprises an upper wiring plate 121 and a lower wiring plate 122. An upper contact 121*a* is formed on the upper wiring plate 121. Corresponding to the upper contact 121*a*, a lower contact 122*a* is formed on the lower wiring plate 122. Moreover, the backlight module 14 comprises a light guide plate 141, a reflective plate 142 and a light-emitting element 143.

The operating principle of the key 11 of the conventional illuminated keyboard device 1 will be illustrated in more details as follows. Firstly, the scissors-type connecting element 112 of the key 11 is connected with the keycap 111 and the supporting plate 13. The elastic element 113 is arranged between the keycap 111 and the supporting plate 13, and disposed within an accommodation space of the scissors-type connecting element 112. The membrane switch circuit module 12 is arranged between the elastic element 113 and the supporting plate 13.

As the key 11 is depressed, the keycap 111 is correspondingly moved with the scissors-type connecting element 112 in a vertical direction toward the supporting plate 13, and the membrane switch circuit module 12 is pushed by a protrusion part 113*a* within the elastic element 113. Under this circumstance, the upper contact 121*a* and the lower contact 122*a* of the membrane switch circuit module 12 are contacted with each other to be electrically conducted. Consequently, a corresponding input function is executed.

The illuminating principles of the conventional illuminated keyboard device 1 will be illustrated as follows. Firstly, the light guide plate 141 is located under the supporting plate 13, and the reflective plate 142 is located under the light guide plate 141. The light-emitting element 143 is located at a side of the light guide plate 141. The light-emitting element 143 may emit a light beam. The light beam is introduced into the light guide plate 141. Moreover, a portion of the light beam from the light-emitting element 143 is reflected by the reflective plate 142 so as to be projected upwardly toward the supporting plate 13 and transmitted through an opening 131 of the supporting plate 13. Moreover, the portion of the light beam is transmitted through a light-transmissible part of the keycap 111 so as to result in the illuminating efficacy.

As mentioned above, the conventional illuminated keyboard device 1 has some drawbacks. For example, it is necessary to install the backlight module 14 under the supporting plate 13 in order to result in the illuminating efficacy. Under this circumstance, the overall thickness and the fabricating cost of the conventional illuminated keyboard device 1 are both increased. Moreover, since the distance between the backlight module 14 and the keycap 111 is long, the illuminating efficacy is usually unsatisfied.

Therefore, there is a need of providing an improved illuminated keyboard device in order to overcome the above drawbacks.

SUMMARY OF THE INVENTION

An object of the present invention provides a slim-type illuminated keyboard device.

In accordance with an aspect of the present invention, there is provided an illuminated keyboard device. The illuminated keyboard device includes plural keys, a membrane switch circuit module and plural light-emitting elements. The plural keys include plural keycaps, respectively. Each of the plural keycaps has at least one light outputting zone. The membrane switch circuit module is located under the plural keys. When one of the plural keycaps is depressed, the membrane switch circuit module is triggered to generate a corresponding key signal. The membrane switch circuit module includes an upper wiring plate, a lower wiring plate and a spacer layer. The spacer layer is arranged between the upper wiring plate and the lower wiring plate. The plural light-emitting elements are disposed on a top surface of the upper wiring plate and located under the corresponding keycaps. The plural light-emitting elements emit plural light beams to the corresponding light outputting zones. Moreover, plural light source wiring lines are formed on the top surface of the upper wiring plate, and the plural light-emitting elements are connected with each other through the plural light source wiring lines.

In accordance with another aspect of the present invention, there is provided an illuminated keyboard device. The illuminated keyboard device includes plural keys, a membrane switch circuit module and plural light-emitting elements. The plural keys include plural keycaps, respectively. Each of the plural keycaps has at least one light outputting zone. The membrane switch circuit module is located under the plural keys. When one of the plural keycaps is depressed, the membrane switch circuit module is triggered to generate a corresponding key signal. The membrane switch circuit module includes an upper wiring plate, a lower wiring plate and a spacer layer. The spacer layer is arranged between the upper wiring plate and the lower wiring plate. The plural light-emitting elements are disposed on a top surface of the spacer layer and located under the corresponding keycaps. The plural light-emitting elements emit plural light beams to the corresponding light outputting zones through the upper wiring plate. Moreover, plural light source wiring lines are formed on the top surface of the spacer layer, and the plural light-emitting elements are connected with each other through the plural light source wiring lines.

In accordance with a further aspect of the present invention, there is provided an illuminated keyboard device. The illuminated keyboard device includes plural keys, a membrane switch circuit module and plural light-emitting elements. The plural keys include plural keycaps, respectively. Each of the plural keycaps has at least one light outputting zone. The membrane switch circuit module is located under the plural keys. When one of the plural keycaps is depressed, the membrane switch circuit module is triggered to generate a corresponding key signal. The membrane switch circuit module includes an upper wiring plate, a lower wiring plate and a spacer layer. The spacer layer is arranged between the upper wiring plate and the lower wiring plate. The plural light-emitting elements are disposed on a top surface of the lower wiring plate and located under the corresponding keycaps. The plural light-emitting elements emit plural light beams to the corresponding light outputting zones through the spacer layer and the upper wiring plate. Moreover, plural light source wiring lines are formed on the top surface of the lower wiring plate, and the plural light-emitting elements are connected with each other through the plural light source wiring lines The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
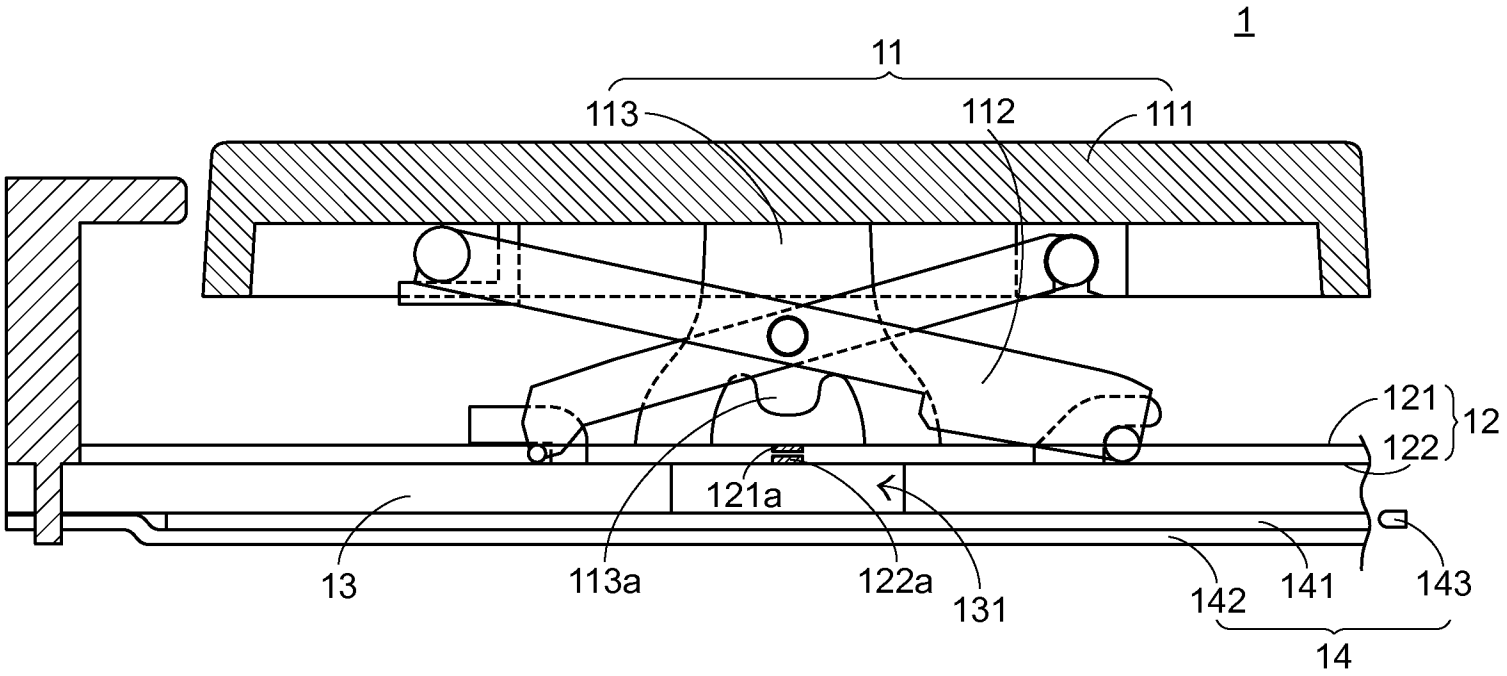
FIG.1 PRIOR ART
FIG. 1 is a schematic cross-sectional view illustrating a conventional illuminated keyboard device.
Figure 2:
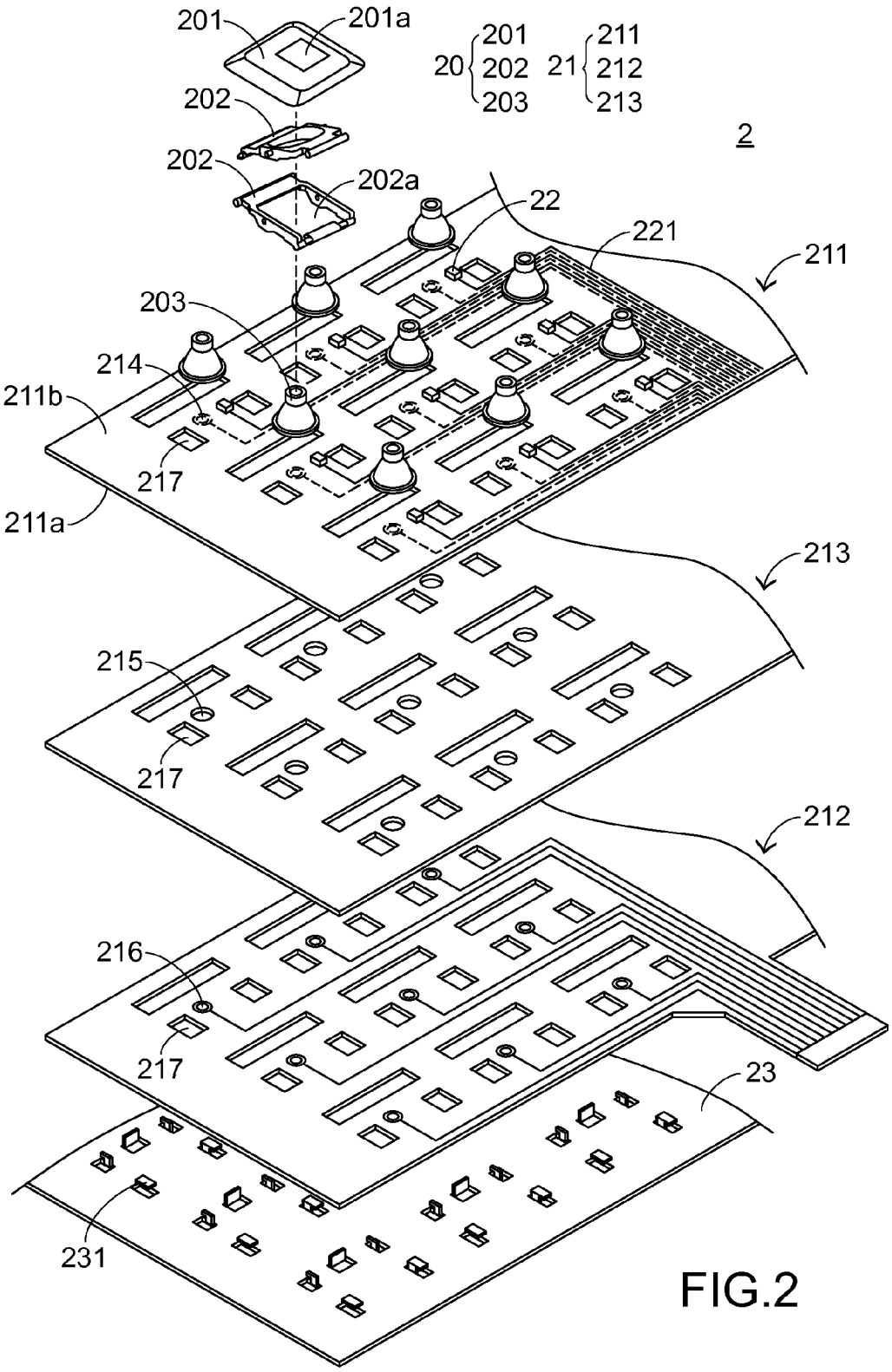
FIG. 2 is a schematic exploded view illustrating the illuminated keyboard device according to a first embodiment of the present invention.
Figure 3:
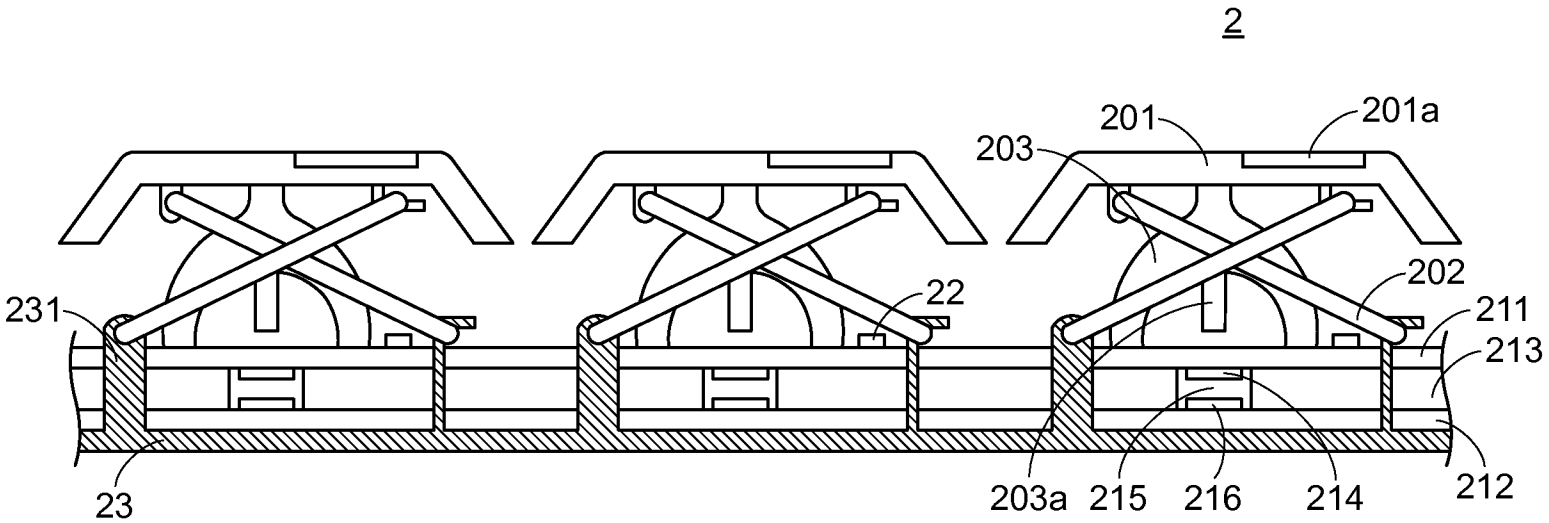
FIG. 3 is a schematic cross-sectional view illustrating the illuminated keyboard device according to the first embodiment of the present invention.

The present invention provides an illuminated keyboard device. Some examples of the illuminated keyboard device of the present invention will be illustrated as follows in more details. Hereinafter, an illuminated keyboard device according to a first embodiment of the present invention will be illustrated with reference to FIGS. 2 and 3. FIG. 2 is a schematic exploded view illustrating the illuminated keyboard device according to the first embodiment of the present invention. FIG. 3 is a schematic cross-sectional view illustrating the illuminated keyboard device according to the first embodiment of the present invention.

Firstly, the components of the illuminated keyboard device 2 will be illustrated as follows. The illuminated keyboard device 2 comprises plural keys 20, a membrane switch circuit module 21, plural light-emitting elements 22 and a supporting plate 23. For clarification and brevity, only one key 20 is shown in FIG. 2.

Each key 20 comprises a keycap 201, a scissors-type connecting element 202 and an elastic element 203. The membrane switch circuit module 21 comprises an upper wiring plate 211, a lower wiring plate 212 and a spacer layer 213. Moreover, plural upper contacts 214 are disposed on a bottom surface 211*a* of the upper wiring plate 211 and connected with each other. In FIG. 2, the plural upper contacts 214 are indicated by dotted lines. The spacer layer 213 is located under the upper wiring plate 211 and comprises plural perforations 215. The lower wiring plate 212 is located under the spacer layer 213 and comprises plural lower contacts 216. Each upper contact 214 is aligned with a corresponding perforation 215 and a corresponding lower contact 216. The upper contact 214, the corresponding perforation 215 and the corresponding lower contact 216 are collectively defined as a key switch for generating a key signal.

The sequence of assembling the illuminated keyboard device 2 will be illustrated as follows. Firstly, as shown in FIG. 3, the plural light-emitting elements 22 are disposed on the membrane switch circuit module 21, and the membrane switch circuit module 21 is arranged between the plural keys 20 and the supporting plate 23. In particular, the plural elastic elements 203 are disposed on a top surface 211*b* of the upper wiring plate 211 and connected with the corresponding keycaps 201. The plural elastic elements 203 are located over the corresponding upper contacts 214. In an embodiment, the plural elastic elements 203 are separate components that are individually adhered on the upper wiring plate 211. Alternatively, in another embodiment, the plural elastic elements 203 are connected with each other. The plural scissors-type connecting elements 202 are disposed on the top surface 211*b* of the upper wiring plate 211 and connected with the corresponding keycaps 201. Each elastic element 203 is disposed within an accommodation space 202*a* of the corresponding scissors-type connecting element 202.

Moreover, the supporting plate 23 comprises plural supporting bulges 231. The plural supporting bulges 231 are respectively penetrated through plural openings 217 of the membrane switch circuit module 21 and exposed to the top surface 211*b* of the upper wiring plate 211. Moreover, the plural supporting bulges 231 are connected with the corresponding scissors-type connecting elements 202. Consequently, the plural scissors-type connecting elements 202 are fixed over the membrane switch circuit module 21. As shown in FIG. 2, each scissors-type connecting element 202 is connected with five supporting bulges 231. It is noted that the number of the supporting bulges 231 is not restricted. That is, the number of the supporting bulges 231 corresponding to each scissors-type connecting element 202 may be altered according to the practical requirements.

After the above assembling procedures are completed, the illuminated keyboard device 2 of the present invention is fabricated. When one of the keycaps 201 is depressed, the depressed keycap 201 is stably moved downwardly to compress the corresponding elastic element 203 through the corresponding scissors-type connecting element 202. Consequently, the protrusion 203*a* within the elastic element 203 is moved downwardly to push the upper wiring plate 211. Under this circumstance, the upper contact 214 of the upper wiring plate 211 under the elastic element 203 is inserted into the corresponding perforation 215 of the spacer layer 213, and contacted with the lower contact 216 of the lower wiring plate 212. Consequently, a corresponding key signal is generated. When the keycap 201 is no longer depressed, the elastic element 203 provides an elastic force to the keycap 201. In response to the elastic force and with the assistance of the scissors-type connecting element 202, the keycap 201 is stably moved upwardly to the original position where the keycap 201 is not depressed.

Moreover, the plural light-emitting elements 22 are disposed on the top surface 211*b* of the upper wiring plate 211 and located under the corresponding keycaps 201. Moreover, plural light source wiring lines 221 are formed on the top surface 211*b* of the upper wiring plate 211. In FIG. 2, the plural light source wiring lines 221 are indicated by solid lines. Moreover, each of the plural light-emitting elements 22 is disposed within the accommodation space 202*a* of the corresponding scissors-type connecting element 202. In particular, the light-emitting element and the corresponding elastic element 203 within the same accommodation space 202*a* are located adjacent to each other.

Preferably but not exclusively, one light-emitting element 22 is located under one keycap 201. According to the practical requirements, plural light-emitting elements 22 are located under one keycap 201. For example, in case that the keycap 201 is relatively longer, plural light-emitting elements 22 are located under the keycap 201. After the above assembling procedures are completed, the light beam emitted by each light-emitting element 22 is projected upwardly to the corresponding keycap 201. Consequently, the light beam is outputted from a light outputting zone 201*a* of the corresponding keycap 201 so as to result in the illuminating efficacy.

As mentioned above, the plural light-emitting elements 22 and the plural light source wiring lines 221 are disposed on the top surface 211*b* of the upper wiring plate 211 of the membrane switch circuit module 21. Since it is not necessary to install the backlight module, the overall thickness of the illuminated keyboard device 2 of the present invention is reduced. Moreover, in the above embodiment, the plural light-emitting elements 22 are disposed on the top surface 211*b* of the upper wiring plate 211, and the upper wiring plate 211 is located at the topmost layer of the membrane switch circuit module 21. Consequently, it is not necessary to form openings in the membrane switch circuit module 21 or the supporting plate 23 for allowing the light beams from the plural light-emitting elements 22 to go through. Moreover, since only the plural keys 20 and the plural light-emitting elements 22 are disposed on the top surface 211*b* of the upper wiring plate 211 and no other wiring lines are formed on the top surface 211*b* of the upper wiring plate 211, the plural light source wiring lines 221 can be formed on arbitrary locations of the top surface 211*b* of the upper wiring plate 211. Consequently, the process complexity of the illuminated keyboard device 2 is effectively reduced. Moreover, since the plural light-emitting elements 22 are disposed on the top surface 211*b* of the upper wiring plate 211 and disposed within the accommodation spaces 202*a* of the corresponding scissors-type connecting elements 202, the light beams from the plural light-emitting elements 22 can be directly projected to the plural keycaps 201 without being obstructed. Under this circumstance, the illuminating efficacy with enhanced light intensity can be provided.

Some variant examples of the illuminated keyboard device of the present invention will be illustrated in the following embodiments from a second embodiment to a sixth embodiment.

Figure 4:
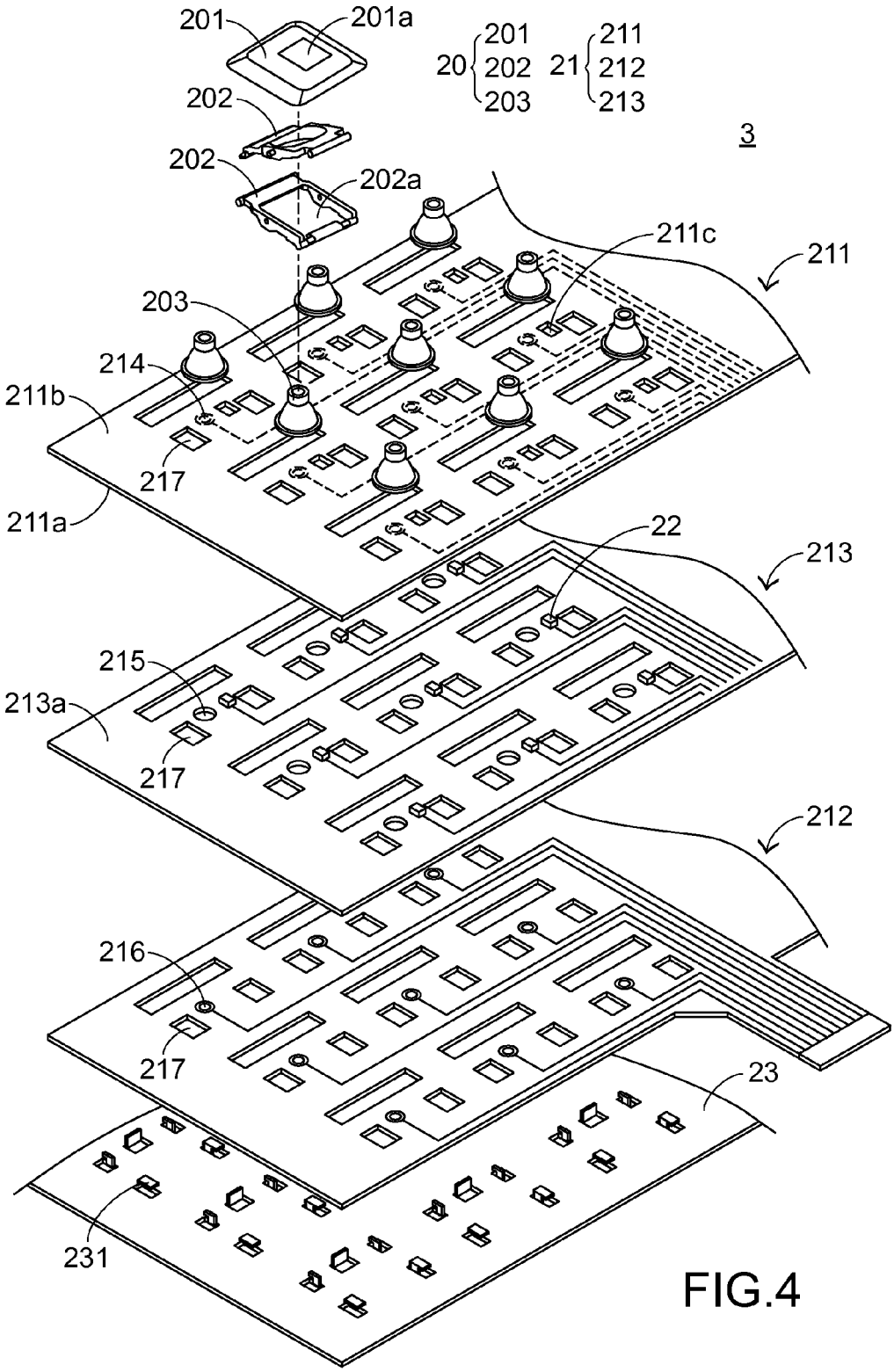
FIG. 4 is a schematic exploded view illustrating the illuminated keyboard device according to a second embodiment of the present invention.
Figure 5:
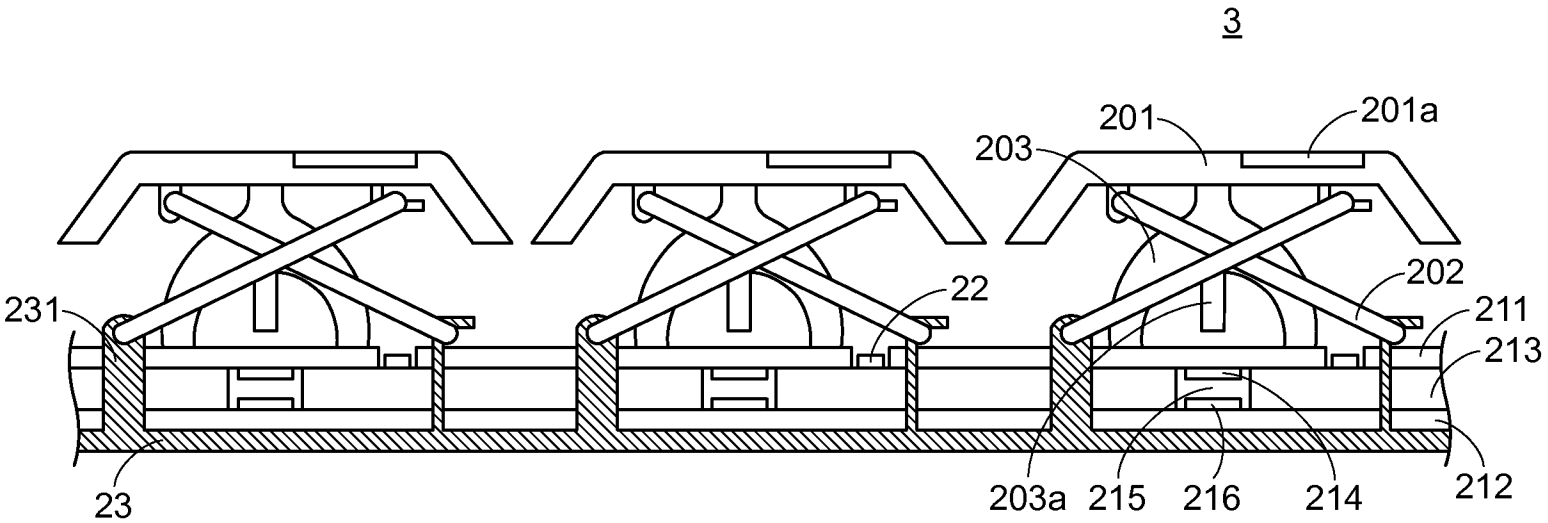
FIG. 5 is a schematic cross-sectional view illustrating the illuminated keyboard device according to the second embodiment of the present invention.

Hereinafter, an illuminated keyboard device 3 according to a second embodiment of the present invention will be illustrated with reference to FIGS. 4 and 5. FIG. 4 is a schematic exploded view illustrating the illuminated keyboard device according to the second embodiment of the present invention. FIG. 5 is a schematic cross-sectional view illustrating the illuminated keyboard device according to the second embodiment of the present invention.

In comparison with the first embodiment, the plural light-emitting elements 22 of the illuminated keyboard device 3 in this embodiment are disposed on a top surface 213*a* of the spacer layer 213. In particular, the upper wiring plate 211 has plural openings 211*c*. The plural light-emitting elements 22 are inserted into the corresponding openings 211*c* of the upper wiring plate 211 and exposed to the underlying regions of the corresponding keycaps 201. The plural light source wiring lines 221 are formed on the top surface 213*a* of the spacer layer 213. The plural light-emitting elements 22 are connected with each other through the plural light source wiring lines 221.

Similarly, the plural light-emitting elements 22 and the plural light source wiring lines 221 of the illuminated keyboard device 3 in this embodiment are disposed on the top surface 213*a* of the spacer layer 213 of the membrane switch circuit module 21. Since it is not necessary to install the backlight module, the overall thickness of the illuminated keyboard device 3 of the present invention is reduced. Moreover, since no other elements and no other wiring lines are disposed on the spacer layer 213, the plural light source wiring lines 221 can be formed on arbitrary locations of the spacer layer 213. Consequently, the process complexity of the illuminated keyboard device 3 is effectively reduced. Moreover, since the light beams from the plural light-emitting elements 22 can be directly projected to the plural keycaps 201, the illuminating efficacy with enhanced light intensity can be provided.

The structure and operating principle of the illuminated keyboard device 3 of this embodiment are similar to those of the illuminated keyboard device 2 of the first embodiment, and are not redundantly described herein.

Figure 6:
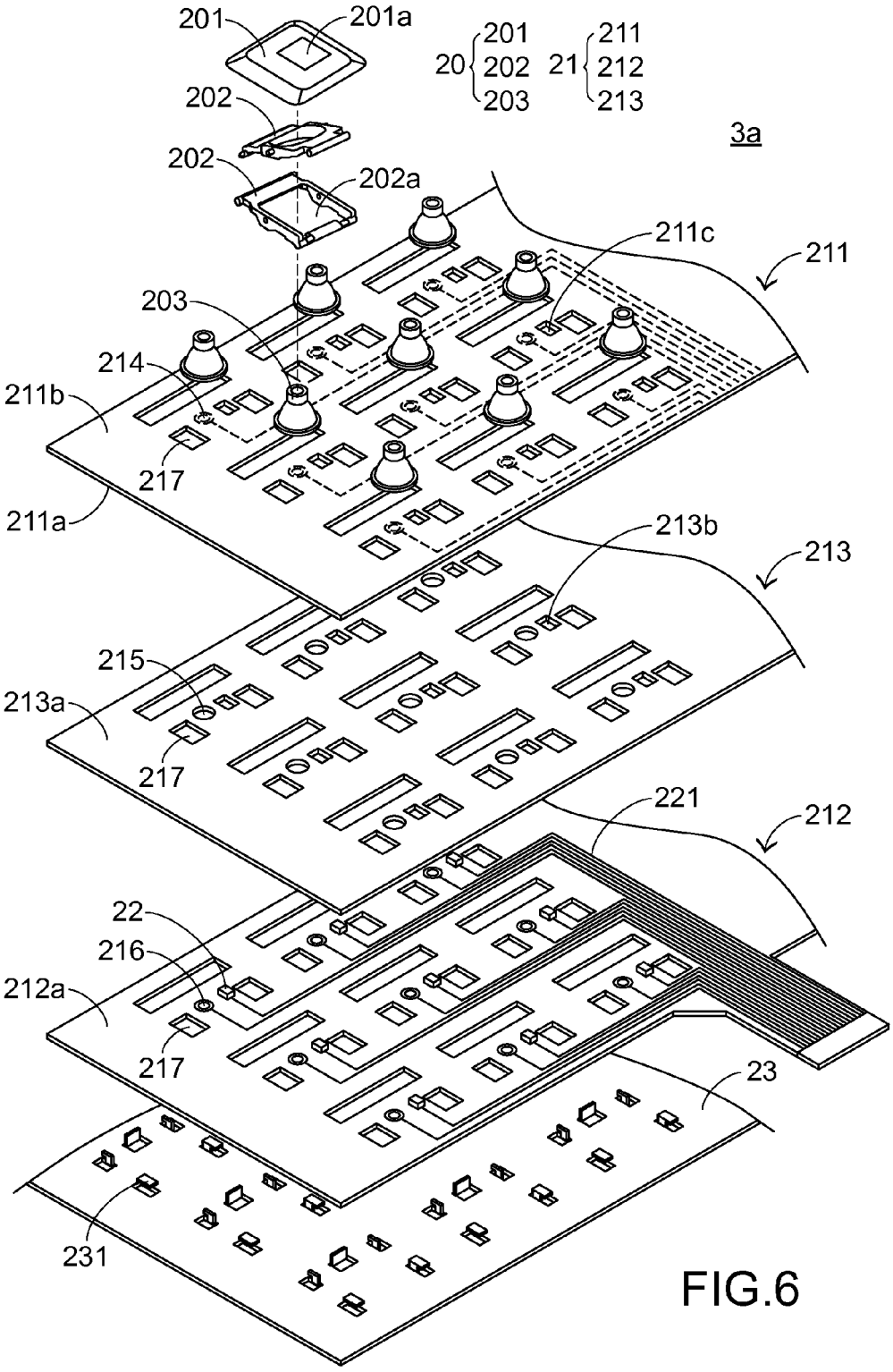
FIG. 6 is a schematic exploded view illustrating the illuminated keyboard device according to a third embodiment of the present invention.
Figure 7:
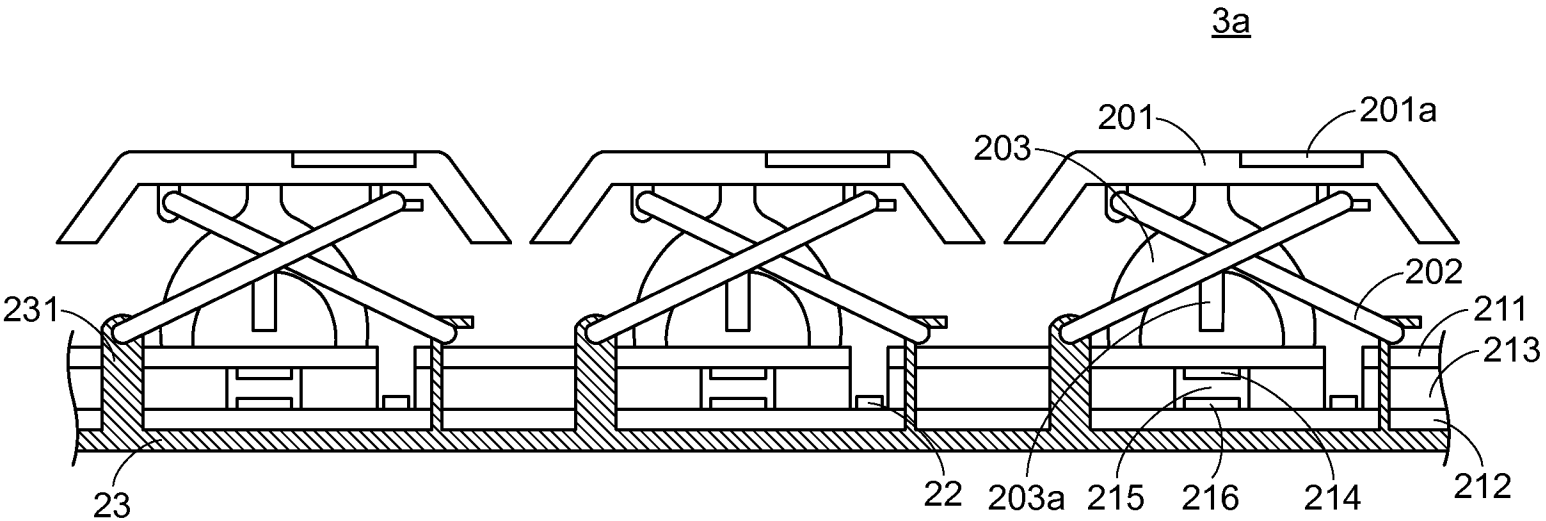
FIG. 7 is a schematic cross-sectional view illustrating the illuminated keyboard device according to the third embodiment of the present invention.

Hereinafter, an illuminated keyboard device 3*a* according to a third embodiment of the present invention will be illustrated with reference to FIGS. 6 and 7. FIG. 6 is a schematic exploded view illustrating the illuminated keyboard device according to the third embodiment of the present invention. FIG. 7 is a schematic cross-sectional view illustrating the illuminated keyboard device according to the third embodiment of the present invention.

In comparison with the first embodiment, the plural light-emitting elements 22 of the illuminated keyboard device 3*a* in this embodiment are disposed on a top surface 212*a* of the lower wiring plate 212. In particular, the upper wiring plate 211 has plural openings 211*c*, and the spacer layer 213 has plural openings 213*b* in communication with the plural openings 211*c*. The plural light-emitting elements 22 are inserted into the corresponding openings 213*b* of the spacer layer 213 and exposed to the underlying regions of the corresponding keycaps 201. The plural light source wiring lines 221 are formed on the top surface 212*a* of the lower wiring plate 212. The plural light-emitting elements 22 are connected with each other through the plural light source wiring lines 221.

Similarly, the plural light-emitting elements 22 and the plural light source wiring lines 221 of the illuminated keyboard device 3*a* in this embodiment are disposed on the top surface 212*a* of the lower wiring plate 212 of the membrane switch circuit module 21. Since it is not necessary to install the backlight module, the overall thickness of the illuminated keyboard device 3*a* of the present invention is reduced. Moreover, since the light beams from the plural light-emitting elements 22 can be directly projected to the plural keycaps 201, the illuminating efficacy with enhanced light intensity can be provided.

The structure and operating principle of the illuminated keyboard device 3*a* of this embodiment are similar to those of the illuminated keyboard device 2 of the first embodiment, and are not redundantly described herein.

Figure 8:
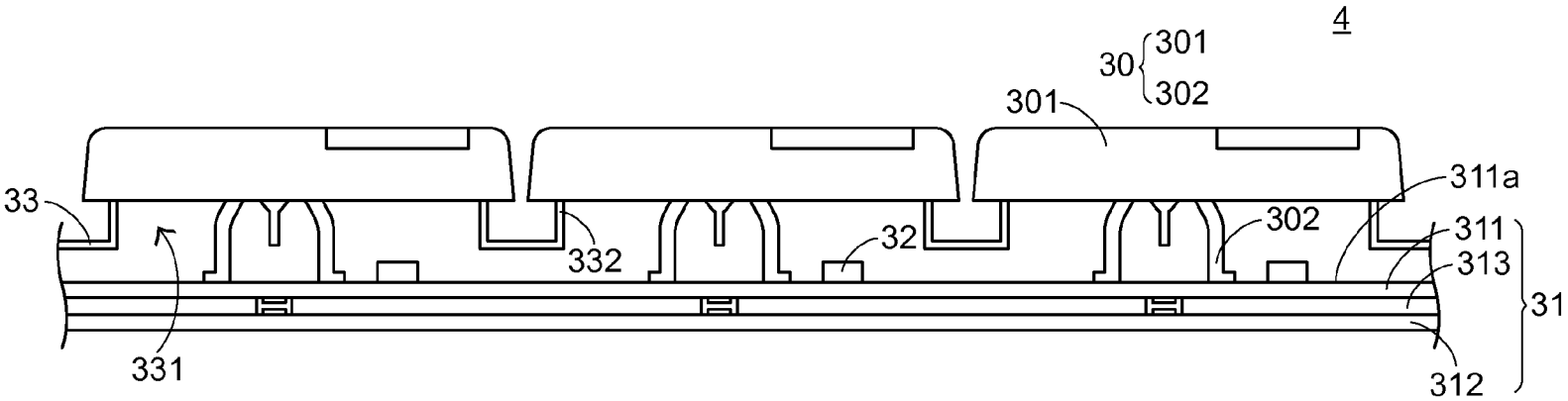
FIG. 8 is a schematic cross-sectional view illustrating the illuminated keyboard device according to a fourth embodiment of the present invention.

Hereinafter, an illuminated keyboard device 4 according to a fourth embodiment of the present invention will be illustrated with reference to FIG. 8. FIG. 8 is a schematic cross-sectional view illustrating the illuminated keyboard device according to the fourth embodiment of the present invention. The illuminated keyboard device 4 comprises plural keys 30, a membrane switch circuit module 31, plural light-emitting elements 32 and a supporting plate 33. The membrane switch circuit module 31 comprises an upper wiring plate 311, a lower wiring plate 312 and a spacer layer 313. The plural light-emitting elements 32 are disposed on a top surface 311*a* of the upper wiring plate 311 and located under the corresponding keycaps 301.

In comparison with the first embodiment, each key 30 of the illuminated keyboard device 4 of this embodiment comprises a keycap 301 and an elastic element 302. The supporting plate 33 is arranged between the plural keycaps 301 of the plural keys 30 and the membrane switch circuit module 31. Moreover, the supporting plate 303 comprises plural receiving slots 331. The plural receiving slots 331 are located under the corresponding keycaps 301. The plural light-emitting elements 32 and the plural elastic elements 302 are disposed on the membrane switch circuit module 31. Moreover, each light-emitting element 32 and the adjacent elastic element 302 and disposed within the corresponding receiving slot 331. Moreover, each receiving slot 331 is surrounded by a supporting bulge 332. The plural supporting bulges 332 are locked into the corresponding keycaps 301. Consequently, the plural keycaps 301 are movable upwardly or downwardly relative to the membrane switch circuit module 31. The structure and operating principle of the illuminated keyboard device 4 of this embodiment are similar to those of the illuminated keyboard device 2 of the first embodiment, and are not redundantly described herein.

Figure 9:
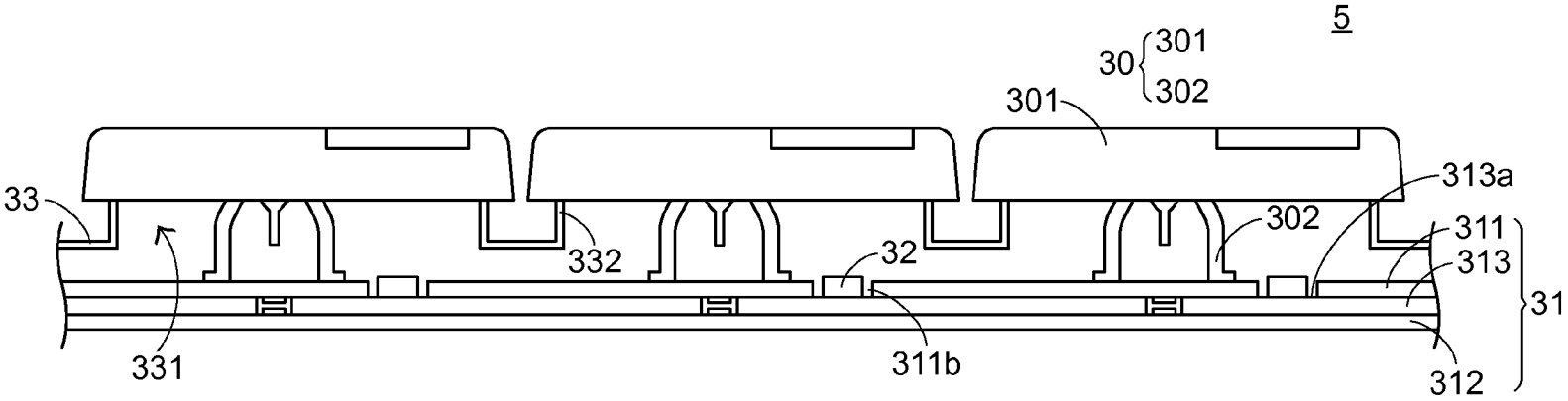
FIG. 9 is a schematic cross-sectional view illustrating the illuminated keyboard device according to a fifth embodiment of the present invention.

Hereinafter, an illuminated keyboard device 5 according to a fifth embodiment of the present invention will be illustrated with reference to FIG. 9. FIG. 9 is a schematic cross-sectional view illustrating the illuminated keyboard device according to the fifth embodiment of the present invention.

In comparison with the fourth embodiment, the plural light-emitting elements 32 are disposed on a top surface 313*a* of the spacer layer 313, and the upper wiring plate 311 has plural openings 311*b*. The plural light-emitting elements 32 are inserted into the corresponding openings 311*b* of the upper wiring plate 311 and exposed to the underlying regions of the corresponding receiving slots 331 of the supporting plate 33. The structure and operating principle of the illuminated keyboard device 5 of this embodiment are similar to those of the illuminated keyboard device 4 of the fourth embodiment, and are not redundantly described herein.

Figure 10:
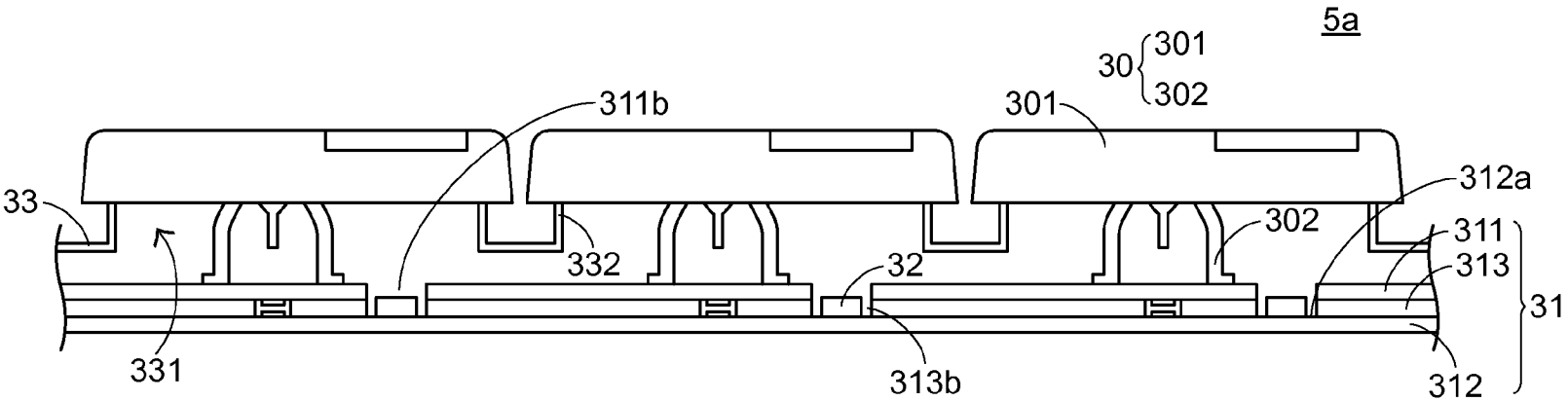
FIG. 10 is a schematic cross-sectional view illustrating the illuminated keyboard device according to a sixth embodiment of the present invention.

Hereinafter, an illuminated keyboard device 5*a* according to a sixth embodiment of the present invention will be illustrated with reference to FIG. 10. FIG. 10 is a schematic cross-sectional view illustrating the illuminated keyboard device according to the sixth embodiment of the present invention.

In comparison with the fourth embodiment, the plural light-emitting elements 32 are disposed on a top surface 312*a* of the lower wiring plate 312, the upper wiring plate 311 has plural openings 311*b*, and the spacer layer 313 has plural openings 313*b* in communication with the plural openings 311*b*. The plural light-emitting elements 32 are inserted into the corresponding openings 313*b* of the spacer layer 313 and exposed to the underlying regions of the corresponding receiving slots 331 of the supporting plate 33. The structure and operating principle of the illuminated keyboard device 5*a* of this embodiment are similar to those of the illuminated keyboard device 4 of the fourth embodiment, and are not redundantly described herein.

In the first, third, fourth or sixth embodiment, the spacer layer is an insulation film or an insulation ink layer. Moreover, since the plural light-emitting elements and the plural light source wiring lines are formed on the spacer layer in the second or fifth embodiment, the spacer layer is a physical structure (e.g., an insulation film).

Moreover, for scattering the light beams and increasing the light outputting ranges of the light-emitting elements, the surfaces of the light-emitting elements may be coated with diffusion ink or the light-emitting elements may be covered by light shades.

From the above descriptions, the present invention provides the illuminated keyboard device. The plural light-emitting elements and the plural light source wiring lines are disposed on the top surface of the upper wiring plate, the lower wiring plate or the spacer layer of the membrane switch circuit module. Consequently, the overall thickness, the fabricating cost and the process complexity of the illuminated keyboard device are reduced. Moreover, since the light-emitting elements are closer to the corresponding keycaps, the illuminating efficacy is enhanced. In other words, the illuminated keyboard device of the present invention can overcome the drawbacks of the conventional illuminated keyboard device.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An illuminated keyboard device, comprising:

plural keys comprising plural keycaps, respectively, wherein each of the plural keycaps has at least one light outputting zone;

a membrane switch circuit module located under the plural keys, wherein when one of the plural keycaps is depressed, the membrane switch circuit module is triggered to generate a corresponding key signal, wherein the membrane switch circuit module comprises an upper wiring plate, a lower wiring plate and a spacer layer, and the spacer layer is arranged between the upper wiring plate and the lower wiring plate; and plural light-emitting elements disposed on a top surface of the upper wiring plate and located under the corresponding keycaps, wherein the plural light-emitting elements emit plural light beams to the corresponding light outputting zones, wherein plural light source wiring lines are formed on the top surface of the upper wiring plate, and the plural light-emitting elements are connected with each other through the plural light source wiring lines.

2. The illuminated keyboard device according to claim 1, wherein plural upper contacts are disposed on a bottom surface of the upper wiring plate, the spacer layer has plural perforations corresponding to the plural upper contacts, and the lower wiring plate has plural lower contacts corresponding to the plural upper contacts, wherein when the membrane switch circuit module is pressed, the corresponding upper contact is inserted into the corresponding perforation and contacted with the corresponding lower contact, so that the corresponding key signal is generated.

3. The illuminated keyboard device according to claim 1, wherein the plural keys further comprise:

plural scissors-type connecting elements arranged between the corresponding keycaps and the membrane switch circuit module and connected with the corresponding keycaps, wherein each of the plural keycaps is movable upwardly or downwardly relative to the membrane switch circuit module through the corresponding scissors-type connecting element; and plural elastic elements arranged between the corresponding keycaps and the membrane switch circuit module, wherein each of the plural elastic elements provides an elastic force to the corresponding keycap, and the keycap is restored to an original position in response to the elastic force, wherein each of the plural scissors-type connecting elements has an accommodation space, and the elastic element is disposed within the corresponding accommodation space.

4. The illuminated keyboard device according to claim 3, wherein each of the plural light-emitting elements is disposed within the accommodation space of the corresponding scissors-type connecting element.

5. The illuminated keyboard device according to claim 3, further comprising a supporting plate, wherein the supporting plate is located under the membrane switch circuit module and comprises plural supporting bulges, wherein the plural supporting bulges are penetrated through the membrane switch circuit module and connected with the plural scissors-type connecting elements, so that the plural scissors-type connecting elements are fixed on the supporting plate.

6. The illuminated keyboard device according to claim 1, further comprising a supporting plate, wherein the supporting plate is arranged between the plural keycaps and the membrane switch circuit module, and comprises plural receiving slots, wherein the plural receiving slots are located under the corresponding keycaps, and the plural elastic elements are disposed within the corresponding receiving slots.

7. The illuminated keyboard device according to claim 6, wherein the plural keys further comprise plural elastic elements, respectively, wherein the plural elastic elements are located over the membrane switch circuit module, each of the plural elastic elements provides an elastic force to the corresponding keycap, and the keycap is restored to an original position in response to the elastic force, wherein the elastic element is disposed within the corresponding receiving slot and located adjacent to the corresponding light-emitting element.

8. The illuminated keyboard device according to claim 6, wherein the supporting plate further comprises plural supporting bulges, and the plural supporting bulges are located under the corresponding keycaps, wherein the plural supporting bulges are locked into the corresponding keycaps, so that the keycaps are movable upwardly or downwardly relative to the membrane switch circuit module.

9. The illuminated keyboard device according to claim 1, wherein the spacer layer is an insulation film or an insulation ink layer.

10. An illuminated keyboard device, comprising:

plural keys comprising plural keycaps, respectively, wherein each of the plural keycaps has at least one light outputting zone;

a membrane switch circuit module located under the plural keys, wherein when one of the plural keycaps is depressed, the membrane switch circuit module is triggered to generate a corresponding key signal, wherein the membrane switch circuit module comprises an upper wiring plate, a lower wiring plate and a spacer layer, and the spacer layer is arranged between the upper wiring plate and the lower wiring plate; and plural light-emitting elements disposed on a top surface of the spacer layer and located under the corresponding keycaps, wherein the plural light-emitting elements emit plural light beams to the corresponding light outputting zones through the upper wiring plate, wherein plural light source wiring lines are formed on the top surface of the spacer layer, and the plural light-emitting elements are connected with each other through the plural light source wiring lines.

11. The illuminated keyboard device according to claim 10, wherein the spacer layer is an insulation film.

12. An illuminated keyboard device, comprising:

plural keys comprising plural keycaps, respectively, wherein each of the plural keycaps has at least one light outputting zone;

a membrane switch circuit module located under the plural keys, wherein when one of the plural keycaps is depressed, the membrane switch circuit module is triggered to generate a corresponding key signal, wherein the membrane switch circuit module comprises an upper wiring plate, a lower wiring plate and a spacer layer, and the spacer layer is arranged between the upper wiring plate and the lower wiring plate; and plural light-emitting elements disposed on a top surface of the lower wiring plate and located under the corresponding keycaps, wherein the plural light-emitting elements emit plural light beams to the corresponding light outputting zones through the spacer layer and the upper wiring plate, wherein plural light source wiring lines are formed on the top surface of the lower wiring plate, and the plural light-emitting elements are connected with each other through the plural light source wiring lines.

13. The illuminated keyboard device according to claim 12, wherein the spacer layer is an insulation film.

* * * * *